US009347255B2

(12) United States Patent
Benevenga et al.

(10) Patent No.: US 9,347,255 B2
(45) Date of Patent: May 24, 2016

(54) MOVABLE CHANNEL REINFORCEMENT APPARATUS FOR WINDOW ASSEMBLIES

(71) Applicant: Andersen Corporation, Bayport, MN (US)

(72) Inventors: Dominick Benevenga, North Haledon, NJ (US); Juan Cornejo, East Brunswick, NJ (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 14/315,011

(22) Filed: Jun. 25, 2014

(65) Prior Publication Data

US 2014/0373464 A1 Dec. 25, 2014

Related U.S. Application Data

(60) Provisional application No. 61/838,966, filed on Jun. 25, 2013.

(51) Int. Cl.

| | |
|---|---|
| ***E05F 1/00*** | (2006.01) |
| ***E06B 3/44*** | (2006.01) |
| ***E05C 5/04*** | (2006.01) |
| *E05C 7/00* | (2006.01) |

(52) U.S. Cl.

CPC ... *E06B 3/44* (2013.01); *E05C 5/04* (2013.01); *E05C 2007/007* (2013.01)

(58) Field of Classification Search

CPC ..... E06B 3/44; E05C 5/04

USPC ..... 49/445, 446, 447, 176, 181, 183, 184, 49/185

See application file for complete search history.

(56) References Cited

U.S. PATENT DOCUMENTS

| | | | | |
|---|---|---|---|---|
| 6,802,156 | B2 | 10/2004 | Sherrett et al. | |
| 7,069,694 | B2 | 7/2006 | Fullick | |
| 7,363,747 | B2 | 4/2008 | Heck et al. | |
| 7,415,797 | B2 | 8/2008 | Dotson et al. | |
| 8,966,822 | B2 * | 3/2015 | Sofianek et al. | 49/430 |
| 2005/0155301 | A1 * | 7/2005 | Hapka et al. | 52/210 |
| 2007/0056217 | A1 | 3/2007 | Silverman | |
| 2007/0157521 | A1 * | 7/2007 | Ito et al. | 49/185 |
| 2014/0373450 | A1 * | 12/2014 | Benevenga et al. | 49/183 |

* cited by examiner

*Primary Examiner* — Jerry Redman

(74) *Attorney, Agent, or Firm* — Mueting, Raasch & Gebhardt, P.A.

(57) ABSTRACT

Channel reinforcements configured to move between open and closed location along with a window sash are described herein. The channel reinforcements may provide reinforcement to window jambs proximate the latch bolts that extend into jamb channels in the window jambs. The channel reinforcements may be coupled or uncoupled to the balances located in the window jambs.

18 Claims, 12 Drawing Sheets

MOVABLE CHANNEL REINFORCEMENT APPARATUS FOR WINDOW ASSEMBLIES

CROSS REFERENCE TO RELATED APPLICATION

This application claims the benefit of U.S. Provisional Patent Application Ser. No. 61/838,966 entitled "TILT WINDOW ASSEMBLY WITH MOVING CHANNEL REINFORCEMENTS" and filed on Jun. 25, 2013, which is incorporated herein by reference in its entirety.

BACKGROUND

Movable channel reinforcement apparatus for window assemblies is described herein.

Tilt sash windows (e.g., vinyl tilt sash windows, wood tilt sash windows, metal tilt sash windows, etc.) may not perform, or stand up, well in high winds such as, e.g., provided by hurricanes, etc. For example, the tilt latches may fail (e.g., breaking, detaching, etc.) and/or the structure around the tilt latches such as the frame and/or sash of the window may fail and/or break. Some conventional ways of reinforcing window frames of tilt sash windows may include adding fixed reinforcement members to the channels of the jambs in which the sashes runs (e.g., the reinforcement members may be fixedly coupled to the channel so as to restrict any movement of the fixed reinforcement members relative the channel). Such fixed reinforcement members may limit the travel of the window sashes when attempting to lift it to its maximum opening, which may interfere with the ability of the window to meet one or more standards regarding certain opening sizes for emergency egress.

SUMMARY

The present disclosure describes exemplary channel reinforcements located within channels of window jambs. The exemplary channel reinforcements may be configured to provide additional support structure to the channels of the window jambs when engaged or acted on by a tilt latch bolt to, e.g., withstand high winds and/or forces (such as from hurricanes). Additionally, the exemplary channel reinforcements may move with a window sash as it is moved up and down so as to not restrict the movement of the window sash.

One exemplary tilt window assembly may include a window frame, first and second sashes, first and second jamb, or latch, channels, first and second latch mechanisms, and first and second channel reinforcements. The window frame may include a first jamb and a second jamb and may define a frame opening. The first sash may be mounted in the frame opening between the first and second jambs and the second sash may be mounted in the frame opening between the first and second jambs. The second sash may be configured to move along a length of the first and second jambs between an open position and a closed position.

The first jamb, or latch, channel may be located in the first jamb and a second jamb, or latch, channel may be located in the second jamb. The first latch mechanism and the second latch mechanism may be attached to the second sash. The first latch mechanism may include a first latch bolt configured to move within the first jamb channel of the first jamb as the second sash is moved between the open position and the closed position, and the second latch mechanism may be configured to move within the second jamb channel of the second jamb as the second sash is moved between the open position and the closed position.

The first channel reinforcement may be located in the first channel and a second channel reinforcement may be located in the second channel. The first channel reinforcement may be configured to move within the first channel between an open location when the second sash is in the open position and a closed location when the second sash is in the closed position. The second channel reinforcement may be configured to move within the second channel between an open location when the second sash is in the open position and a closed location when the second sash is in the closed position.

In one or more embodiments, the first and second channel reinforcement may be configured to provide reinforcement to the first and second jamb channels, respectively, when located in the closed location by distributing forces applied to the first and second channel reinforcement by the first and the second latch bolts, respectively. In at least one embodiment, the first and second channel reinforcements are configured to distribute the forces applied by the first and the second latch bolts, respectively, to at least a portion of the first and second jambs, respectively, defining a surface parallel to a plane defined by the window frame.

In one or more embodiments, the exemplary tilt window assembly may further include a first balance located in the first jamb and coupled to the second sash and a second balance located in the second jamb and coupled to the second sash. The first channel reinforcement may be coupled to the first balance and the second channel reinforcement may be coupled to the second balance. Further, each of the first channel reinforcement and the second channel reinforcement may be configured to move with the first and second balance when the second sash moves between the open position and the closed position.

In one or more embodiments, the first channel reinforcement may include a reinforcing block. In at least one embodiment, the first channel reinforcement may further include a follower catch separated from the reinforcing block within the first channel. The first balance, the first latch bolt, and/or any other part or portion coupled to the second sash may be configured to act on the reinforcing block to move the first channel reinforcement to the closed location as the second sash moves from the open position to the closed position. Further, the first channel reinforcement may be configured such that gravity moves it to the closed location as the second sash moves from the open position to the closed position. In at least one embodiment, the reinforcing block and the follower catch of the first channel reinforcement may be located a fixed distance apart from each other within the first channel. In at least one embodiment, the reinforcing block and the follower catch of the first channel reinforcement may be attached to each other by a connector, and the distance between the reinforcing block and the follower catch of the first channel reinforcement along the connector may be adjustable. In one or more embodiments, the reinforcing block and follower catch may be a single molded part. In one or more embodiments, the reinforcing block and follower catch may be one or more parts coupled together. Further, each of the reinforcing block and follower catch may include a plurality of parts or portions.

In one or more embodiments, the second channel reinforcement may include a reinforcing block. In at least one embodiment, the second channel reinforcement may further include a follower catch separated from the reinforcing block within the second channel. The second balance, the second latch bolt, and/or any other part or portion coupled to the second sash may be configured to act on the reinforcing block to move the first channel reinforcement to the closed location as the second sash moves from the open position to the closed position. Further, the second channel reinforcement may be configured such that gravity moves it to the closed location as the second sash moves from the open position to the closed position. In at least one embodiment, the reinforcing block and the follower catch of the second channel reinforcement may be located a fixed distance apart from each other within the second channel. In at least one embodiment, the reinforcing block and the follower catch of the second channel reinforcement may be attached to each other by a connector, and the distance between the reinforcing block and the follower catch of the second channel reinforcement along the connector may be adjustable.

In one or more embodiments, the first channel reinforcement may include a reinforcing block and a follower catch separated from each other within the first channel. The follower catch may be configured to act on a support structure located within the first jamb channel to position the first channel reinforcement in the closed location as the second sash moves from the open position to the closed position.

One exemplary channel reinforcement for reinforcing a window jamb of a window assembly may include a reinforcing block extending from a first end to a second end and defining a reinforcing channel extending from the first end to the second end. The reinforcing block may be configured to move within a jamb channel of a window jamb between an open location when a window sash is in the open position and a closed location when the window sash is in the closed position. The reinforcing channel may be configured to engage a latch bolt of a latch mechanism of the window sash when in the closed location. In at least one embodiment, the channel reinforcement may further include a plurality of rib portions extending from an exterior surface of the reinforcing block. In at least one embodiment, the reinforcing block may define a "U"-shape or an "L"-shape. In at least one embodiment, the reinforcing block may be configured to engage at least one leg of the channel when a perpendicular force is applied to the window sash.

In one or more embodiments, the reinforcing block may be configured to be coupled to a balance that is coupled to the window sash and located within the jamb channel. For example, the reinforcing block may define a notch configured to be coupled to a balance that is coupled to the window sash and located within the jamb channel.

In one or more embodiments, the channel reinforcement may further include a coupling portion coupled to the reinforcing block and configured to be coupled to a balance that is coupled to the window sash and located within the jamb channel. In at least one embodiment, the channel reinforcement may further include a connector portion coupling the coupling portion to the reinforcing block, wherein the connector portion is configurable to adjust a distance between the coupling portion and the reinforcing block such that reinforcing block is positioned proximate the latch bolt of the window sash of a plurality of different-sized window assemblies.

In one or more embodiments, the reinforcing block may define a cord channel within the reinforcing channel configured to allow a balance cord of a balance to extend therethrough without interfering with the movement of the reinforcing block between the open location and the closed location.

In one or more embodiments, the channel reinforcement may further include a follower catch separated from the reinforcing block within the jamb channel. The follower catch may be configured to be acted on by the latch bolt to move the reinforcing block to the closed location as the window sash moves from the open position to the closed position and/or to act on a support structure located within the jamb channel to position the reinforcing block in the closed location as the window sash moves from the open position to the closed position.

In one or more embodiments, the reinforcing block may be configured to provide reinforcement to the jamb channel when located in the closed location by distributing forces applied to the reinforcing block by the latch bolt. For example, the reinforcing block may be configured to distribute the forces applied by the latch bolt to at least a portion of the jamb defining a surface parallel to a plane defined by the window sash.

The above summary is not intended to describe each embodiment or every implementation of the present disclosure. A more complete understanding will become apparent and appreciated by referring to the following detailed description and claims taken in conjunction with the accompanying drawings.

DETAILED DESCRIPTION OF EXEMPLARY EMBODIMENTS

In the following detailed description of illustrative embodiments, reference is made to the accompanying figures of the drawings which form a part hereof, and in which are shown, by way of illustration, specific embodiments which may be practiced. It is to be understood that other embodiments may be utilized and structural changes may be made without departing from (e.g., still falling within) the scope of the disclosure presented hereby.

Exemplary apparatus shall be described with reference to FIGS. 1-11. It will be apparent to one skilled in the art that elements from one embodiment may be used in combination with elements of the other embodiments, and that the possible embodiments of such apparatus using combinations of features set forth herein is not limited to the specific embodiments shown in the figures and/or described herein. Further, it will be recognized that the embodiments described herein may include many elements that are not necessarily shown to scale. Still further, it will be recognized that the size and shape of various elements herein may be modified but still fall within the scope of the present disclosure, although certain one or more shapes and/or sizes, or types of elements, may be advantageous over others.

Figure 1:
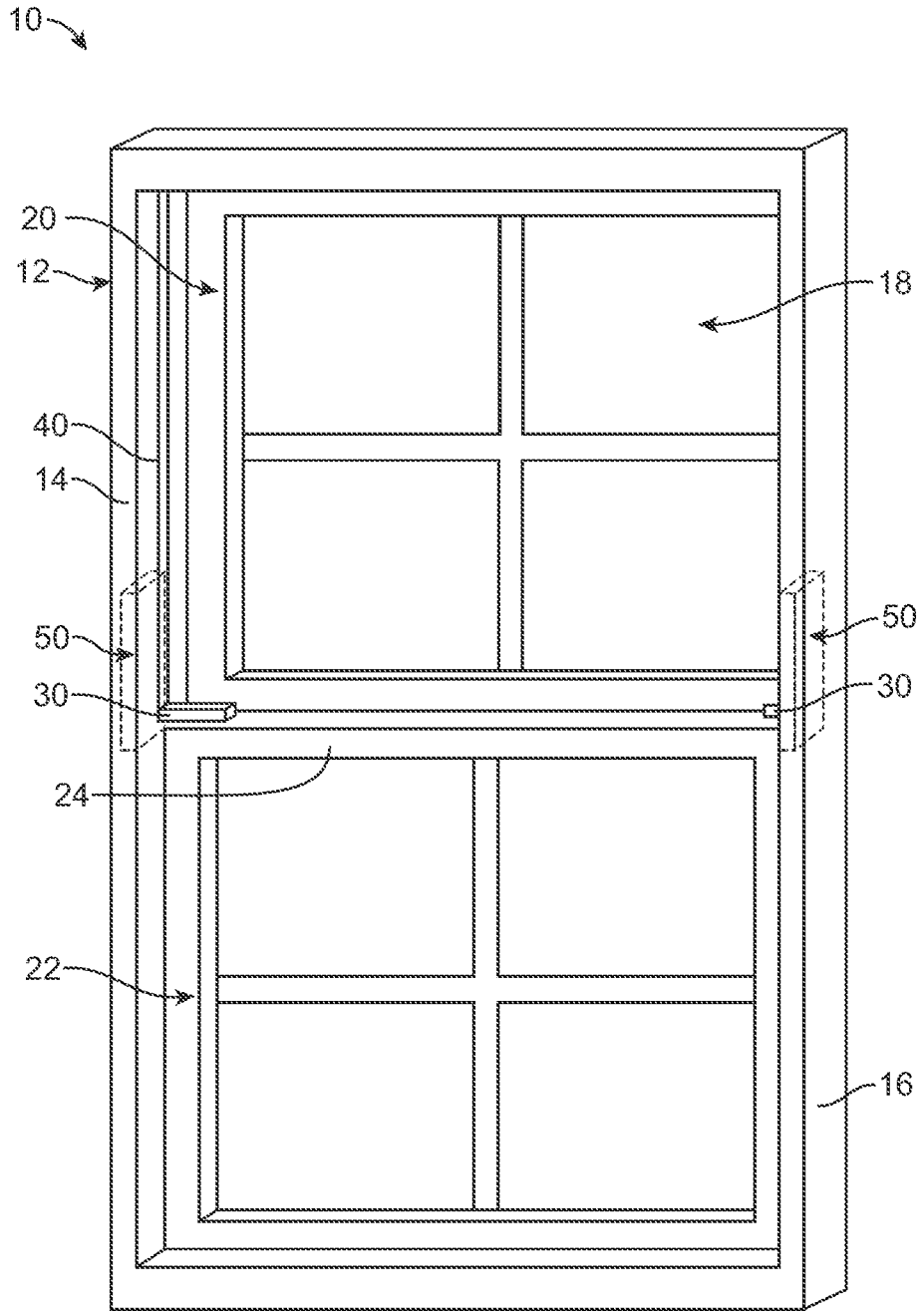
FIG. 1 is a perspective view of an exemplary tilt window assembly including channel reinforcements.

An exemplary tilt window assembly 10 is depicted in FIG. 1. The window frame 12 of the tilt window assembly 10 includes a first jamb 14 on a left side of the assembly 10 and a second jamb 16 on the right side of the assembly 10 and defines a frame opening 18 within which a first sash 20 and a second sash 22 are mounted. One or both of the first sash 20 and the second sash 22 may be moved upwardly and downwardly within the window frame 12 to open and close the window assembly 10.

For example, the second sash 22 (or the first sash 20) may be described as being located between the first and second jambs 14, 16 and configured to move along a vertical length of the first and second jambs 14, 16 between an open position and a closed position. When the second sash 22 is in the open position (e.g., overlapping the first sash 20), the window assembly 10 may be described as being open (e.g., allowing air to flow through the window), and when the second sash 22 is in the closed position (e.g., not overlapping the first sash 20), the window assembly 10 may be described as being closed (e.g., not allowing air to flow through the window).

Latch mechanisms 30 may be attached to a top, or upper, portion 24 of the second sash 22 (e.g., lower sash) to keep, or maintain, the second sash 22 from tilting as shown in FIG. 1. The latch mechanisms 30 may be used to mate with, or be coupled to, jamb, or latch, channels located in the first jamb 14 and second jamb 16, respectively. A portion of jamb channel 40 is viewable in the first jamb 14 depicted in FIG. 1. Although the latch mechanisms 30 are depicted as being located on top portion 24 of the second sash 22, it is to be understood that the latch mechanism 30 may be built into, or integrated with, the second sash 22. Generally, a jamb, or latch, channel may be located in each of the first and second jambs 14, 16 of the window frame 12 and may extend along a vertical axis (e.g., an axis perpendicular to a ground or floor surface), and the latch mechanisms 30 may include a latch bolt that may extend into the jamb, or latch, channel to keep, or maintain, the sash 22 from tilting.

The latch bolt may be configured to move between a retracted position where the latch bolt is not located in a jamb channel and an extended position where the latch bolt is located in the jamb channel. To move the latch bolt between the retracted position and the extended position, a user may push or pull a handle portion coupled to the latch bolt in directions substantially parallel to axis of travel of the bolt. When the latch bolt is in the extended position, the latch bolt may be described as keeping, or maintaining, the sash 22 from tilting, and when the latch bolt is in the retracted position, the latch bolt may be described as allowing, or permitting, the sash 22 to tilt. In other words, the latch bolt may be extended into the jamb channel to keep, or maintain, the sash 22 from tilting and may be retracted to allow, or permit the sash 22 to tilt.

As shown, the exemplary tilt window assembly 10 may include a first channel reinforcement 50 located in the first jamb channel 40 of the first jamb 14 and a second channel reinforcement 50 located in a second jamb channel of the second jamb 16 as shown in FIG. 1. The channel reinforcements 50 may be configured to reinforce the jamb channel proximate the latch bolt of the latch mechanisms 30 when the latch bolt is in an extended position. In other words, the channel reinforcements 50 may provide additional structure to the jamb channels of the jambs 14, 16 such that forces (e.g., wind from hurricanes, forces generally perpendicular to the windows of the assembly, etc.) applied to the sashes 20, 22 may not break, or damage, the jamb channels, jambs 14, 16, latch mechanism 30, and/or any other part or portion of the window assembly 10. It may be described that the channel reinforcements 50 are configured to provide reinforcement to the jamb channels by distributing forces applied to the channel reinforcement 50 by the latch bolts of the latch mechanisms 30. Further, it may be described that the forces applied by the latch bolts of the latch mechanisms 30 due to, e.g., wind, etc., may be distributed by the channel reinforcements 50 to at least a portion of the jambs that defines a surface parallel to a plane defined by the window frame 12, e.g., instead of the forces acting through the latch bolts being applied to a wall of the jam that extends perpendicular to the window frame 12. In one or more embodiments, a reinforcement channel may be defined within the exemplary channel reinforcements 50 that is configured for a latch bolt to extend within when in the extended position. The reinforcement channel may translate, or transfer, forces applied to the second sash 22 from the latch bolt to a reinforcing block of the channel reinforcement 50 and into the channel as will be described further herein.

Additionally, each of the channel reinforcements 50 may be configured to move within their respective channel between an open location when the second sash 22 is in the open position and a closed location when the second sash 22 is in the closed position. When the channel reinforcements 50 are located in the closed location, the channel reinforcement 50 may be located proximate the latch mechanisms 30 to provide support to the portion of the channel within which the channel bolt of the latch mechanism 30 extends. Further, such movement of the channel reinforcements 50 may allow the second sash 22 to not be restricted, or unrestricted, in upward movement by the channel reinforcement 50, which, e.g., may allow the second sash 22 to be completely opened (and located adjacent the first sash), or at least opened further than other windows utilizing fixed channel reinforcements, to provide a proper egress opening. For example, the channel reinforcements 50 may be located closer to the top of the window assembly 10 when in the open location than when in the closed location and may be generally described as being located centrally when in the closed location.

Additionally, one or more channel reinforcements 50 described herein may define a channel configured to allow a latch bolt of a latch mechanism 30 of the second sash 22 to slide therethrough, e.g., such that the latch bolt does not catch on the channel reinforcement 50 when moving the second sash 22 to an open position. In these embodiments, the channel reinforcements 50 may stay generally centrally located within the jamb channel (e.g., as opposed to moving upward and downward significantly with the sash 22). In other words, the channel defined in the channel reinforcement 50 may be configured to avoid any contact with the latch bolt to allow the second sash 22 to completely open and/or not impede movement of the second sash 22.

Figure 2:
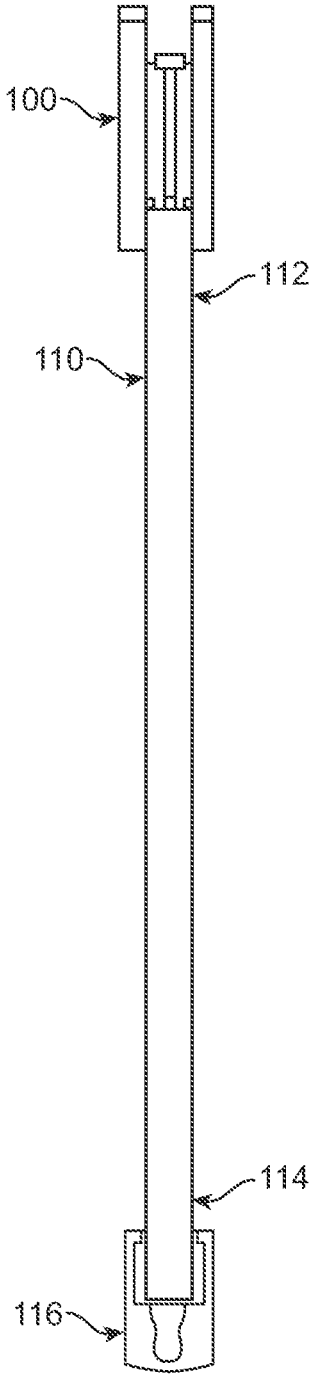
FIG. 2 is a side elevation view of an exemplary channel reinforcement for use with a block and tackle balance.

An exemplary movable channel reinforcement 100 may be coupled to a top region 112 of a block and tackle balance 110 as shown in FIG. 2. Generally, the block and tackle balance 110 may extend from a top region 112 to a bottom region 114. A balance shoe 116 may be coupled, or attached, to the bottom region 114 of the block and tackle balance 110. The block and tackle balance 110 may further include a balance cord 118 extending from the top region 112 and anchored at a balance cord anchor 119 coupled, or attached, to a jamb within the channel 120 of the jamb as shown in FIGS. 3A-3B.

The exemplary channel reinforcement 100 may be described as being with, or coupled to, the balance 110 as the balance 110 moves within the jamb along the jamb channel 120 when the sash 130 which the balance is attached thereto is moved between open and closed positions. For example, the channel reinforcement 100 and balance 110 of FIG. 2 are depicted as being located in a jamb channel 120 in FIGS. 3A-3C. The sash 130, which is depicted diagrammatically to show the position of the sash 130 with respect the channel reinforcement 100, balance 110, and jamb channel 120, is located in the closed position in FIG. 3A and is located in the open position in FIG. 3B.

When a user moves the sash 130 from the closed position to the open position or the closed position to the open position, the channel reinforcement 100 may move with the block and tackle balance 110 along the channel 120. When the sash 130 is in the closed position, the channel reinforcement 110 may be located proximate the latch bolt 132, which is represented by an arrow extending from the diagrammatic sash, to provide additional support and reinforcement to the channel 120 as shown in FIG. 3A. When the sash 130 is in the open position, the channel reinforcement 100 may be located proximate a top portion of the channel 120 and remainder of the window assembly as shown in FIG. 3B.

Figure 3A:
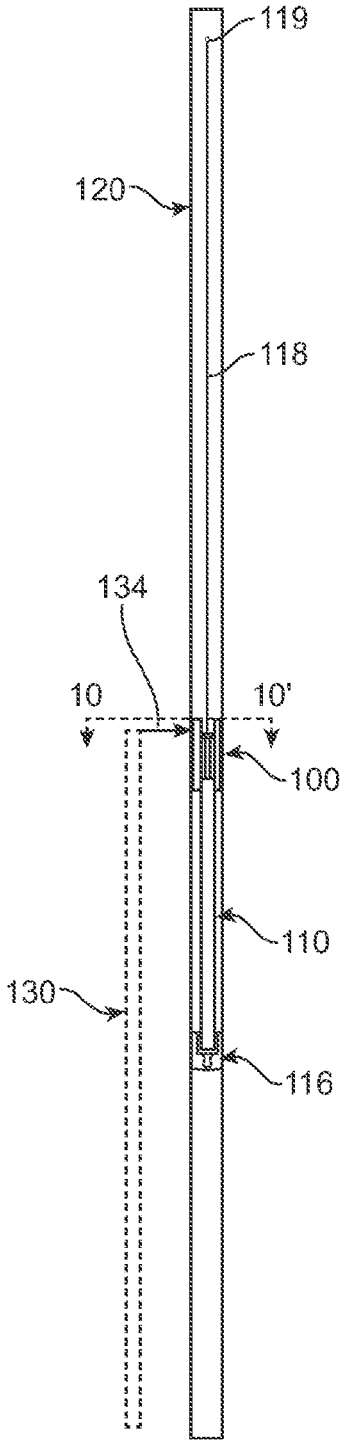
FIGS. 3A-3B are side elevation views of the channel reinforcement of FIG. 2 within a jamb channel with a diagrammatic sash located in a closed and open positions, respectively.
Figure 3B:
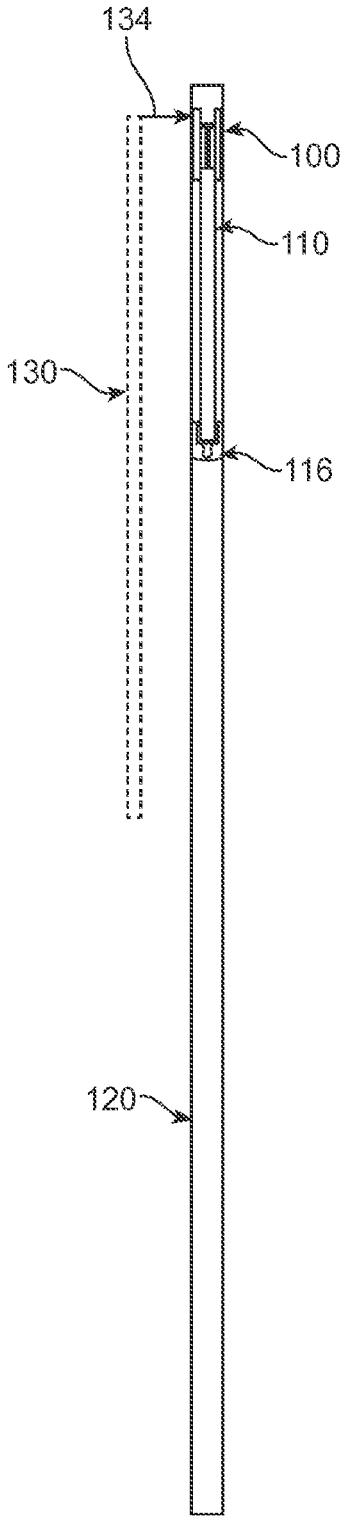
Figure 3C:
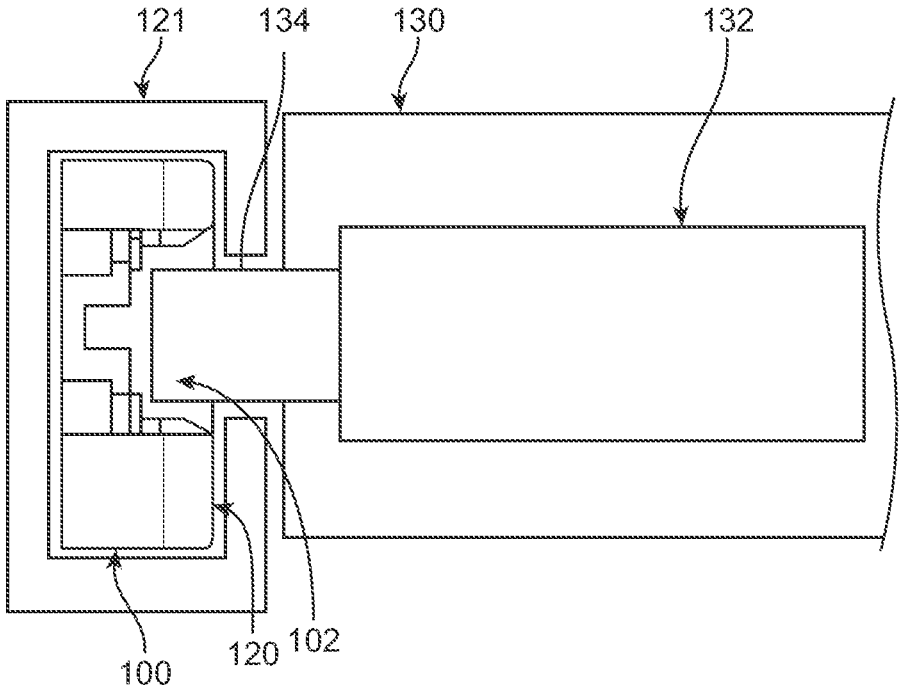
FIG. 3C is a cross-sectional view of the channel reinforcement of FIG. 2 within a jamb with a sash located in the closed position taken across line 10-10' of FIG. 3A.

A cross-sectional view of the channel reinforcement 100 within a jamb 121 with a sash 130 located in the closed position taken across line 10-10' of FIG. 3A is shown in FIG. 3C. As shown, the channel reinforcement 100 is located within the channel 120 of the jamb 121 and the latch bolt 132 of the latch mechanism 132 (which is attached to the top portion of sash 130) is extended into a reinforcement channel 102 defined by the channel reinforcement 100.

Figure 4A:
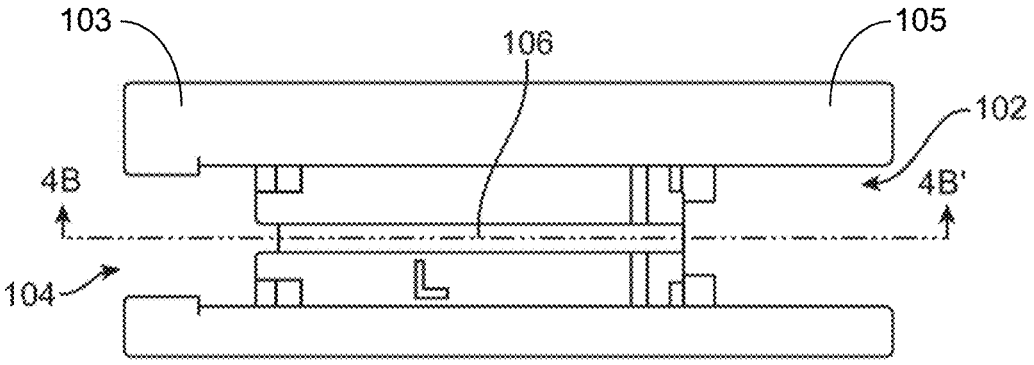
FIGS. 4A-4C are views of the channel reinforcement of FIG. 2.
Figure 4B:
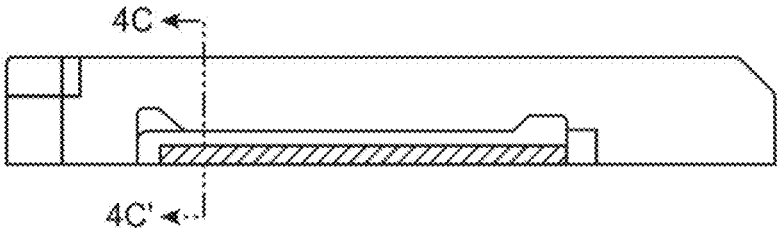
Figure 4C:
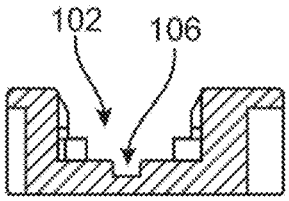

The channel reinforcement 100 is depicted in more detail in FIGS. 4A-4C. As shown, the channel reinforcement 100 may extend from a first end portion 103 to a second end portion 105 and may define a reinforcement channel 102 extending longitudinally along the channel reinforcement 100. The reinforcement channel 102 may be configured to engage a latch bolt when in the closed position to provide support to the channel proximate the latch bolt. Additionally, the channel reinforcement 100 may define a coupling notch 104 located proximate the first end portion 103 configured to engage, and be coupled with, a block and tackle balance 110 (more specifically, the top region or portion 112 of the block and tackle balance 110) so as to, e.g., travel upwardly and downwardly with the block and tackle balance 110. The block and tackle balance 110 may fit within the notch 104 with an interference fit or using any other effective and/or convenient fastening or coupling process, method, or technique. The channel reinforcement 100 may further define a cord, or string, channel 106 extending along the reinforcement channel 102 configured for the balance cord, or string, 118 of a block and tackle balance 110 to be located therein.

The channel reinforcement 100 of FIGS. 2-4 does not include a follower catch similar to some other embodiments because, e.g., the channel reinforcement 100 may be located at the closed location (i.e., proximate the latch bolt when the second sash is in a closed position) by the block and tackle balance 110. In other words, the channel reinforcement 100 may extend from the top region 112 of the block and tackle balance 110 to the top of the second sash 130 (e.g., proximate the second latch bolt).

Figure 5:
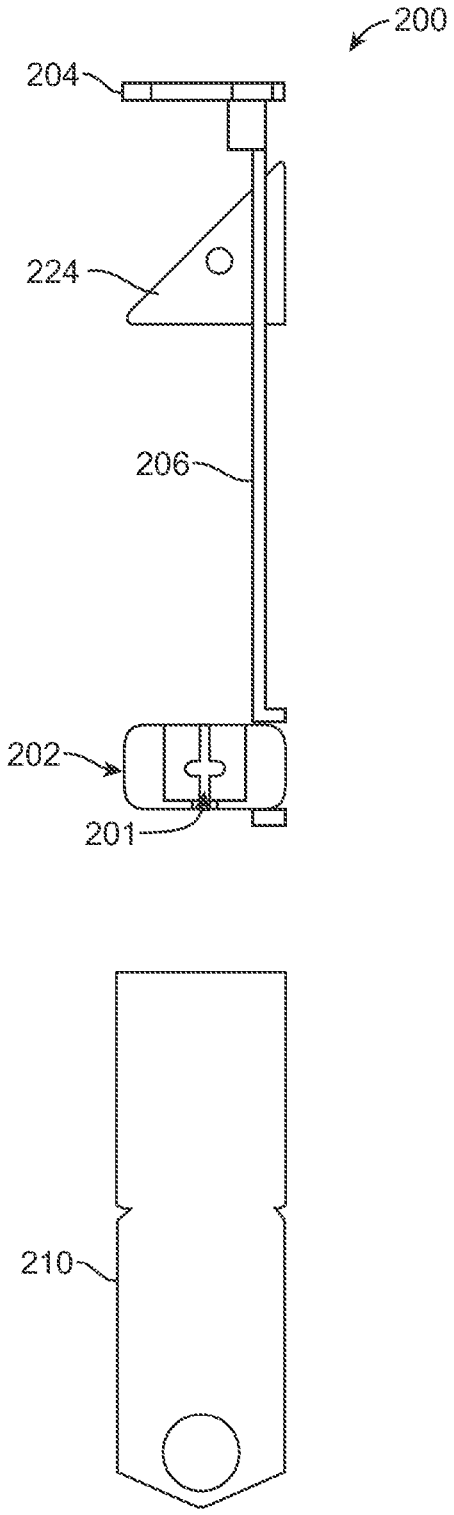
FIG. 5 is a side elevation view of an exemplary channel reinforcement for use with a constant force balance.
Figure 6A:
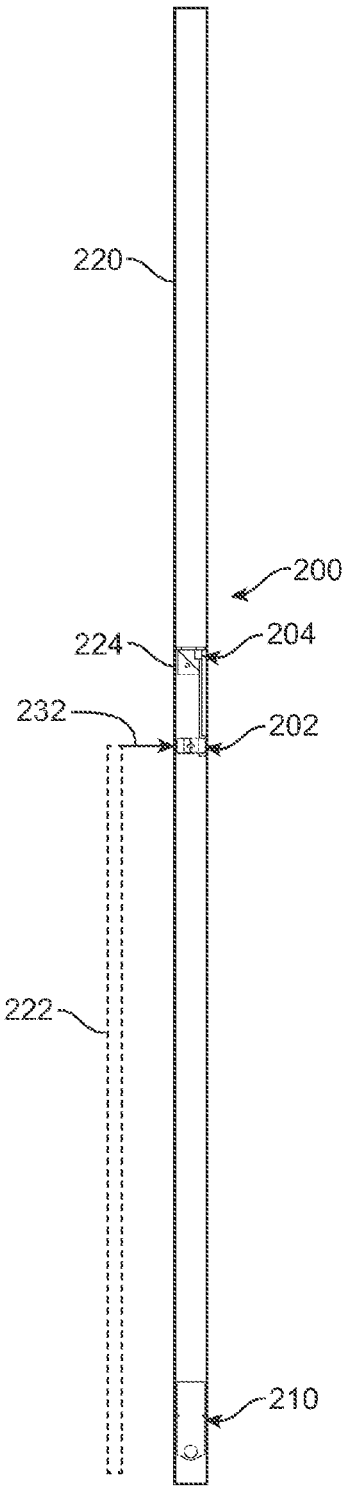
FIGS. 6A-6B are side elevation views of the channel reinforcement of FIG. 5 within a jamb channel with a diagrammatic sash located in a closed and open positions, respectively.
Figure 6B:
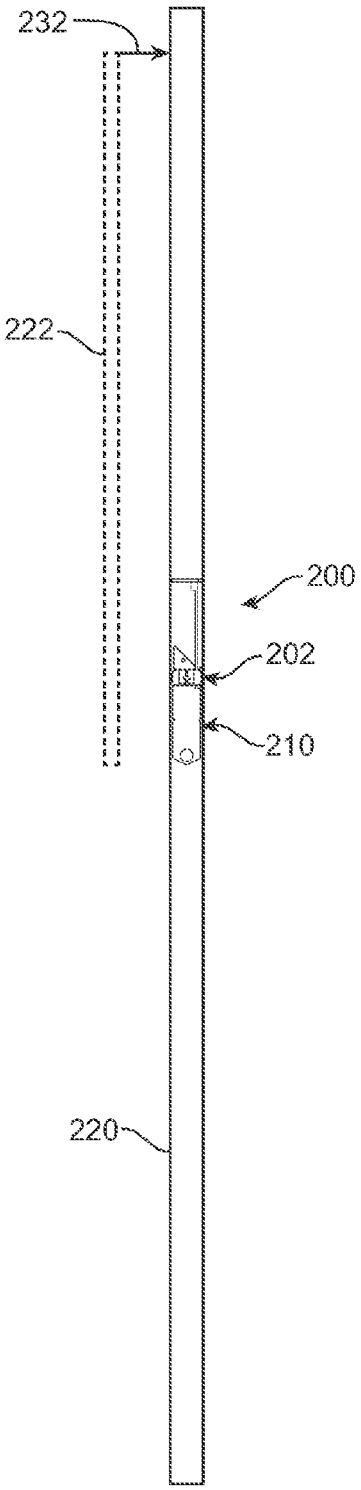
Figure 7A:
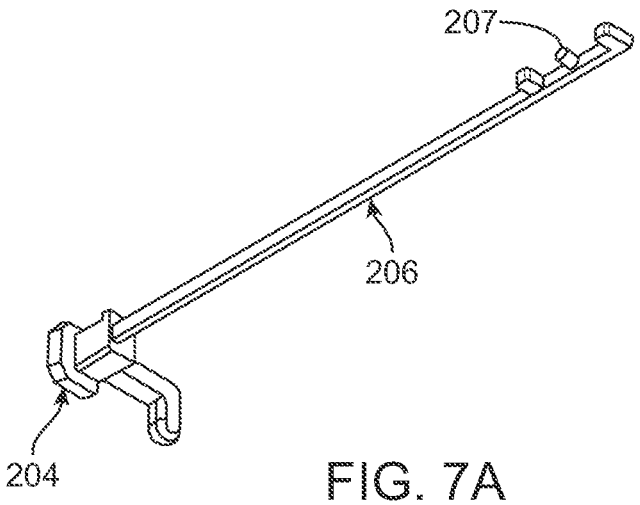
FIGS. 7A-7C are views of an exemplary follower catch and connector of the channel reinforcement of FIG. 5.
Figure 7B:
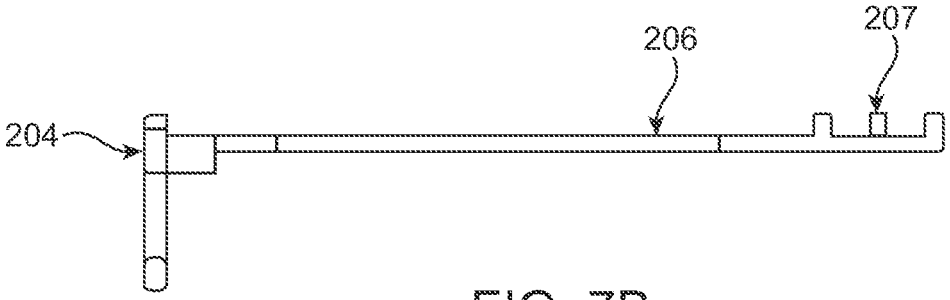
Figure 7C:
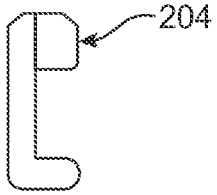
Figure 8A:
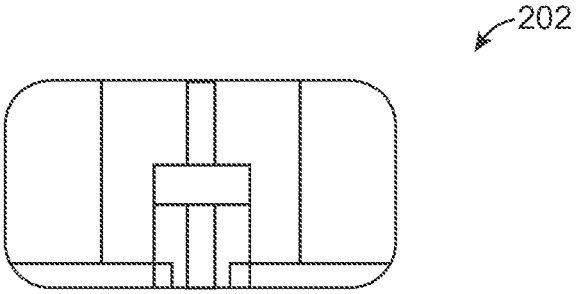
FIGS. 8A-8C are views of an exemplary reinforcing block of the channel reinforcement of FIG. 5.
Figure 8B:
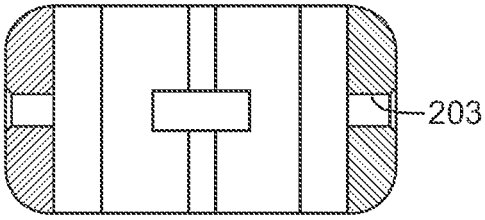
Figure 8C:
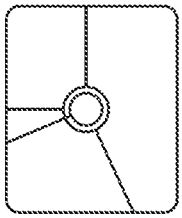

Another exemplary channel reinforcement 200 for use with a constant force balance 210 is depicted in FIGS. 5-7. As shown in FIG. 5, the channel reinforcement 200 may include a reinforcing block 202, a follower catch 204, and a connector 206 coupling the reinforcing block 202 to the follower catch 204. In this embodiment, the reinforcing block 202 may be removable, or detachable, from the connector 206 and the follower catch 204. For example, the connector 206 and follower catch are 204 shown in FIGS. 7A-7C apart from the reinforcing block 202, which is shown by itself in FIGS. 8A-8C. To provide the coupling between the reinforcing block 202 and the connector 206, the reinforcing block 202 may define an aperture 203 as shown in FIGS. 8B-8C that may be configured to mate with a coupling pin 207 of the connector 206 depicted in FIG. 7A.

The follower catch 204 may be configured to "catch" a support structure 224 (e.g., a balance support structures/anchoring point to frame) located within the channel when the second sash is moved into the closed position. The support structure 224 may be fixedly coupled to the jamb and may be configured to be coupled to the spring of the constant force balance 210. In other words, the channel reinforcement 200 may fall, or move downwardly, due to gravity as the constant force balance 210 is moved out of contact, or engagement, with the reinforcing block 202 when the second sash is moved to the closed position, and the follower catch 204 may catch, or stop, the channel reinforcement 200 from falling, or moving further, downwardly. As such, the follower catch 204 may properly position the channel reinforcement 200 in the closed location such that the reinforcing block 202 can support, or reinforce, the channel proximate the latch bolt. In at least one embodiment, the reinforcing block 202 may not be configured to allow the latch bolt to pass therethrough, e.g., by including a structure that may engage the latch bolt such that the latch bolt may move (e.g., drag) the channel reinforcement 200 to the closed location when moving the second sash into the closed position.

The distance between the follower catch 204 and the reinforcing block 202 may be selected such that the reinforcing block 202 is located proximate the latch bolt when the follower catch 204 has caught, or is adjacent to, the support structure when the sash in a closed position. In other words, the distance between the follower catch 204 and the reinforcing block 202 may be similar to the distance between the support structure 224 and the bottom of the first sash. In at least one embodiment, each of the follower catch 204 and the reinforcing block 202 may be configured to allow the latch bolt to pass therethrough when the second sash is being moved into the open position.

The exemplary channel reinforcement 200 and balance 210 of FIG. 5 are depicted as being located in a jamb channel 220 in FIGS. 6A-6B. The sash 222, which is depicted diagrammatically to show the position of the sash 222 with respect the channel reinforcement 200, balance 210, and jamb channel 220, is located in the closed position in FIG. 6A and is located in the open position in FIG. 6B.

The channel reinforcement 200 may move between an open location and a closed location when the sash 222 is located in the open position and the closed position, respectively. When the sash 222 is in the closed position as shown in FIG. 6A, the channel reinforcement 200 may be located proximate the latch bolt 232, which is represented by an arrow extending from the diagrammatic sash 222, to provide additional support and reinforcement to the channel 220. To position the reinforcing block 202 of the channel reinforcement 200 proximate the latch bolt 232 when the sash 222 is in the closed position, the follower catch 204 of the channel reinforcement 200 may catch the support structure 224 and hang therefrom. In at least one embodiment, the reinforcing block 202 may not be configured to allow the latch bolt 232 to pass therethrough, e.g., by including a structure that may engage the latch bolt 232 such that the latch bolt may move (e.g., drag) the channel reinforcement 200 to the closed location when moving the second sash 222 into the closed position.

When the sash 222 is in the open position as shown in FIG. 6B, the channel reinforcement 200 may be moved upwardly by the constant force balance 210 until contacting, or engaging, the support structure 224. The latch bolt 232 of the sash 222 may configured to slide through a channel 201 defined in at least a portion of the channel reinforcement 200 when the sash 222 is moved from the closed position to the open position such that, e.g., the channel reinforcement 200 does not interfere with the sash 222 being located in the open position.

Figure 9:
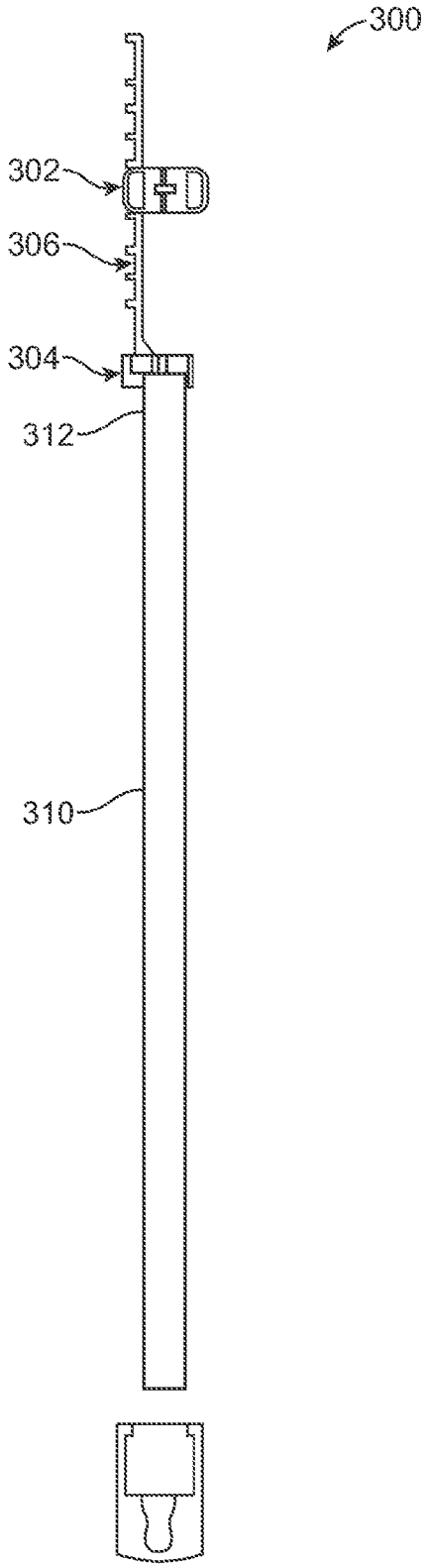
FIG. 9 is a side elevation view of an exemplary channel reinforcement for use with a block and tackle balance.
Figure 10A:
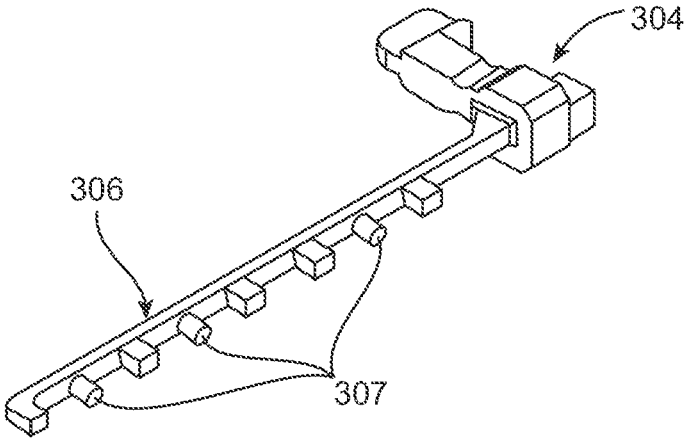
FIGS. 10A-10B are views of an exemplary connector of the channel reinforcement of FIG. 9.
Figure 10B:
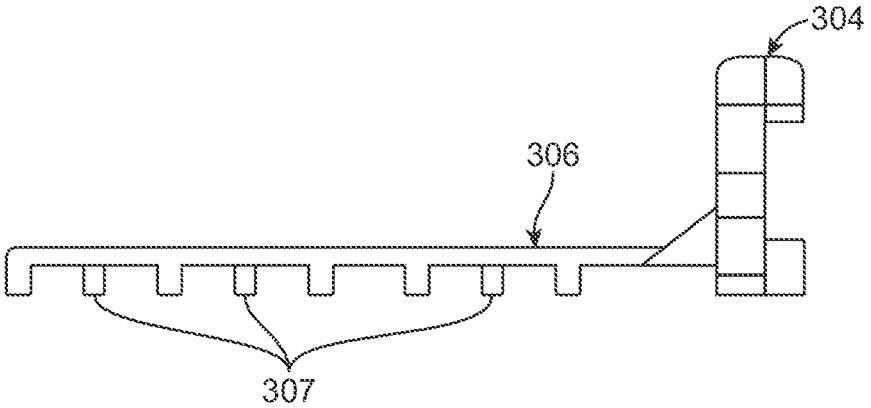

Another exemplary channel reinforcement 300 for use with a block and tackle balance 310 is depicted in FIGS. 9-10. In this embodiment, the channel reinforcement 300 may mate to a block and tackle balance 310 similar to the embodiment depicted in FIGS. 2-4 and may also be adjustable such that the distance between a bottom of the connector 306 (or the top portion 312 of the block and tackle balance 310) and the reinforcing block 302 may be adjusted or selected. More specifically, the channel reinforcement 300 may include a coupling portion, or block, 304 that is configured to couple the channel reinforcement 300 to the block and tackle balance 310. The adjustability of the location of the reinforcing block 302 with respect to the block and tackle balance 310 may be useful when using the channel reinforcement 300 with different windows sizes and types and/or different balance sizes and types.

As shown, the channel reinforcement 300 may include a connector 306 that has a plurality of coupling pins 307 that may be used to mate a reinforcing block 302 such as shown in FIG. 10 to the connector 306. The plurality of coupling pins 307 may allow the distance between the reinforcing block 302 of the channel reinforcement 300 along the connector 306 to be adjustable.

The exemplary channel reinforcements described herein may include one or more materials such as, e.g., polymers such as nylon, polymer composites, engineered polymers (e.g., fiberglass-reinforced nylon, etc. and/or metals such as steel, aluminum, tin, zinc, metal alloys (e.g., zinc alloys such as Zamak 3 or Zamak 5), etc.

Figure 11A:
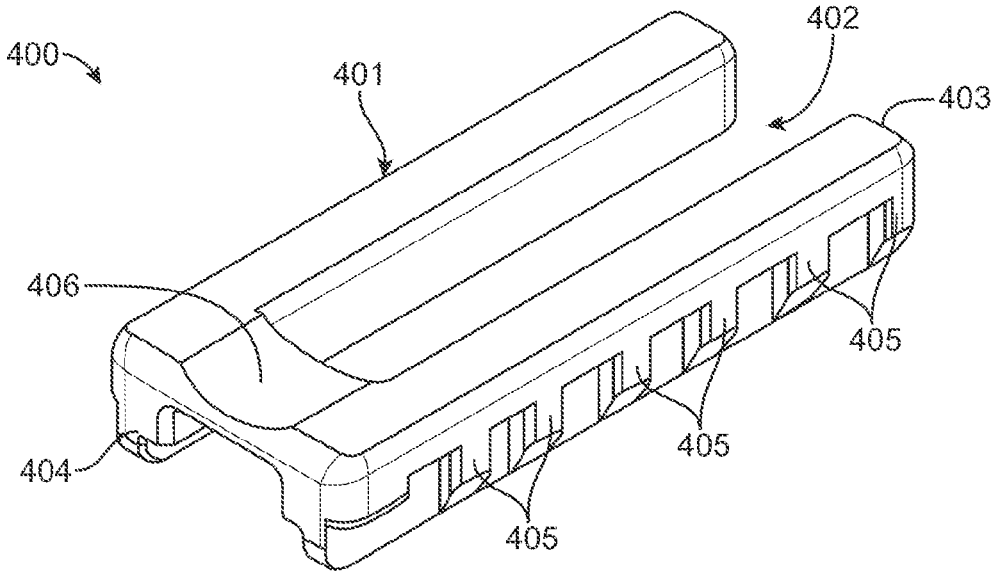
FIGS. 11A-11B are views of an exemplary channel reinforcement.
Figure 11B:
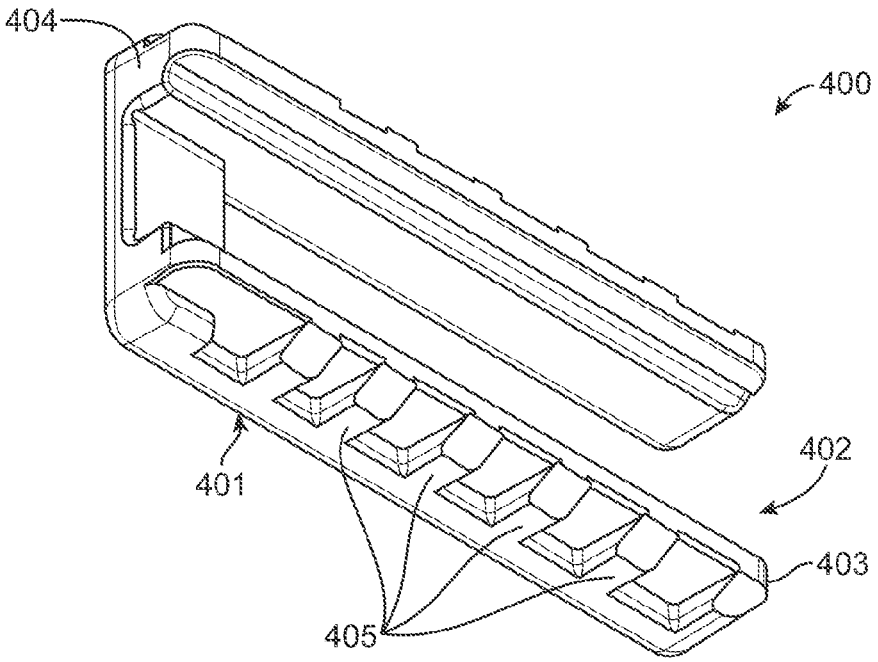

Another exemplary channel reinforcement 400 is depicted in FIGS. 11A-11B. In this embodiment, the channel reinforcement 400 includes a reinforcing block 401 that may be configured for use with a block and tackle balance similar to the embodiment depicted in FIGS. 2-4. The reinforcing block 401 of FIGS. 11A-11B may not be configured to be coupled to the block and tackle balance, and instead may rest on top of the block and tackle balance such that the reinforcing block 401 may move up and down in the channel with the block and tackle balance.

The exemplary reinforcing block of FIGS. 11A-11B may define a reinforcing channel 402 extending from a first end portion 403 to the second end portion 404 and may define a general "U"-shape. The bottom of the "U"-shape may be located adjacent the top of the block and tackle balance. The reinforcing block 401 may further define a plurality of ribs 405 configured, e.g., to add structural support to the reinforcing block, to aid in the molding process, etc.

The reinforcing block 401 may further define an indentation 406 (e.g., a concave indentation) located on a back side of the reinforcing block 401. The indentation 406 may be configured to aid in the insertion of the reinforcing block 401 into a channel of a window (e.g., after the window has already been installed into a structure such as a house). For example, the indentation 406 may provide a selected amount of clearance (e.g., "wiggle" room) to place the reinforcing block 401 into the channel through the opening between a flanges of the channel. In at least one method of locating an exemplary channel reinforcement 400 into a channel, at least a portion of the jamb defining the channel (e.g., a flange portion, etc.) may be removed from the jamb. In at least another method of locating exemplary channel reinforcement into a channel, the channel reinforcement may be slide into the end of the channel/jamb prior to manufacture of the window.

One or more exemplary channel reinforcements may include one or more features configured to provide insertion within a jamb channel. For example, the exemplary reinforcing block 401 may include the indentation 406. Other exemplary channel reinforcements may define a specific shape such that the channel reinforcements may be tilted and snapped into the jamb channel (e.g., specific geometry, specific flexibility, etc.). Further, one exemplary reinforcing block may define an L-shape. Still further, another exemplary channel reinforcement may include two or more parts, or portions, that may be slipped into a jamb channel and then assembled, or coupled together, within the jamb channel.

Although the reinforcing block 401 is described herein as resting on the top of a block and tackle balance and moving along with the balance, in one or more embodiments, the reinforcing block 401, or any other reinforcing block described herein, may be configured to move with the latch bolt. For example, a reinforcing block may include structures that do not allow a latch bolt to move vertically (when in the extended position within the jamb channel) without also moving the reinforcing block with it. When the latch bolt is retracted for tilting, a spring, or another mechanism/apparatus, on the reinforcing block may be configured to press against the jamb channel and hold the reinforcing block in the same position while the window is tilted, so that the tilt latch could re-engage in the proper position with the reinforcing block when the window is returned to its vertical position.

It is to be understood that window assemblies may utilize a variety of different types and sizes of balances, and thus, it is to be understood that each of the embodiment described herein may be configured for use with any type and/or size of balance used in window assemblies. Further, various types and/or sizes of linkages, or coupling portions, configured to couple the channel reinforcements to the different types and/or sizes of balances may be used with the embodiments described herein. In other words, different linkage designs may be used for different types and/or sizes of balances.

In the embodiments in which the channel reinforcement is not attached, or coupled, to a balance or another structure to move downwardly with the structure, one or more various devices or apparatus may be used to ensure that the channel reinforcement is positioned in the closed location when the sash in the closed position. For example, a roller running with a torsion spring running against a surface of the jamb channel may be configured to position the channel reinforcement to the closed location. Further, other methods of spring loading the reinforcing block may also be used to position the channel reinforcement to the closed location.

Exemplary latch mechanisms with rotating latch bolts and tilt window assemblies that may be used with the various embodiments described herein may be described within U.S. Provisional Patent Application Ser. No. 61/838,969 filed on Jun. 25, 2013 and entitled "LATCH MECHANISMS WITH ROTATING LATCH BOLTS AND TILT WINDOW ASSEMBLIES USING SAME" and U.S. Patent Application entitled "LATCH MECHANISMS WITH ROTATING LATCH BOLTS AND TILT WINDOW ASSEMBLIES USING SAME" (U.S. patent application Ser. No. 14/315, 046) and filed on the same day herewith, each of which is incorporated herein by reference in its entirety.

Although the exemplary channel reinforcements are described herein within respect to the vertical jamb channels for tilt window assemblies, it is to be understood that the same, or similar, apparatus may be used in horizontal jambs such as, e.g., in horizontal sliding windows. Additionally, the use of channel reinforcements in horizontal configurations may be configured to reduce the possibility of a sash being loaded in such a way that it moves to the side a sufficient distance to cause one of the tilt latches to come out of the channel.

All patents, patent documents, and references cited herein are incorporated in their entirety as if each were incorporated separately. This disclosure has been provided with reference to illustrative embodiments and is not meant to be construed in a limiting sense. As described previously, one skilled in the art will recognize that other various illustrative applications may use the techniques as described herein to take advantage of the beneficial characteristics of the exemplary apparatus described herein. Various modifications of the illustrative embodiments, as well as additional embodiments of the disclosure, will be apparent upon reference to this description.

What is claimed is:

1. A window assembly comprising:

a window frame including a first jamb and a second jamb, wherein the window frame defines a frame opening;

a first sash mounted in the frame opening between the first and second jambs;

a second sash mounted in the frame opening between the first and second jambs, wherein the second sash is configured to move along a length of the first and second jambs between an open position and a closed position;

a first jamb channel in the first jamb and a second jamb channel in the second jamb;

a first latch mechanism and a second latch mechanism attached to the second sash, wherein the first latch mechanism comprises a first latch bolt configured to move within the first jamb channel of the first jamb as the second sash is moved between the open position and the closed position, and wherein the second latch mechanism comprises a second latch bolt configured to move within the second jamb channel of the second jamb as the second sash is moved between the open position and the closed position; and a first channel reinforcement apparatus located in the first channel and a second channel reinforcement apparatus located in the second channel, wherein the first channel reinforcement apparatus is configured to move within the first channel between an open location and a closed location, wherein the first channel reinforcement apparatus is in its open location when the second sash is in the open position and the first channel reinforcement apparatus is in its closed location when the second sash is in the closed position, and wherein the second channel reinforcement apparatus is configured to move within the second channel between an open location and a closed location, wherein the second channel reinforcement apparatus is in its open location when the second sash is in the open position and the second channel reinforcement apparatus is in its closed location when the second sash is in the closed position.

2. The window assembly of claim 1 further comprising:

a first balance located in the first jamb channel and coupled to the second sash; and a second balance located in the second jamb channel and coupled to the second sash, wherein the first channel reinforcement apparatus is coupled to the first balance and the second channel reinforcement apparatus is coupled to the second balance, wherein each of the first channel reinforcement apparatus and the second channel reinforcement apparatus is configured to move with the first and second balance, respectively, when the second sash moves between the open position and the closed position.

3. The window assembly of claim 1, wherein the first and second channel reinforcement apparatus are configured to provide reinforcement to the first and second jamb channels, respectively, when located in the closed location by distributing forces applied to the first and second channel reinforcement apparatus by the first and the second latch bolts, respectively.

4. The window assembly of claim 3, wherein the first and second channel reinforcement apparatus are configured to distribute the forces applied by the first and the second latch bolts, respectively, to at least a portion of the first and second jambs, respectively, defining a surface parallel to a plane defined by the window frame.

5. The window assembly of claim 1, wherein each of the first and second channel reinforcement apparatus comprises a reinforcing block extending from a first end to a second end and defining a reinforcing channel extending from the first end to the second end, wherein the reinforcing channel of the first channel reinforcement apparatus is configured to engage the first latch bolt of the first latch mechanism of the second sash when the first channel reinforcement apparatus is in its closed location, and wherein the reinforcing channel of the second channel reinforcement apparatus is configured to engage the second latch bolt of the second latch mechanism of the second sash when the second channel reinforcement apparatus is in its closed location.

6. The window assembly of claim 5, wherein the reinforcing block of the first channel reinforcement apparatus is configured to provide reinforcement to the first jamb channel when the first channel reinforcement apparatus is in its closed location by distributing forces applied to the reinforcing block of the first channel reinforcement apparatus by the first latch bolt, and wherein the reinforcing block of the second channel reinforcement apparatus is configured to provide reinforcement to the second jamb channel when the second channel reinforcement apparatus is in its closed location by distributing forces applied to the reinforcing block of the second channel reinforcement apparatus by the second latch bolt.

7. The window assembly of claim 6, wherein the reinforcing block of the first channel reinforcement apparatus is configured to distribute the forces applied by the first latch bolt to at least a portion of the first jamb, and wherein the reinforcing block of the second channel reinforcement apparatus is configured to distribute the forces applied by the second latch bolt to at least a portion of the second jamb.

8. The window assembly of claim 5, wherein each of the first and second channel reinforcement apparatus further comprises a plurality of rib portions extending from an exterior surface of the corresponding reinforcing block.

9. The window assembly of claim 1, wherein each of the first and second channel reinforcement apparatus defines a "U"-shape.

10. The window assembly of claim 1, wherein each of the first and second channel reinforcement apparatus is configured to engage at least one leg of the corresponding reinforcing channel when a perpendicular force is applied to the second sash.

11. The window assembly of claim 1, wherein each of the first and second channel reinforcement apparatus is configured to be coupled to a balance that is coupled to the second sash and located within the first and second jamb channel, respectively.

12. The window assembly of claim 1, wherein each of the first and second channel reinforcement apparatus defines a notch configured to be coupled to a balance that is coupled to the second sash and located within the first and second jamb channel, respectively.

13. The window assembly of claim 1, wherein each of the first and second channel reinforcement apparatus defines a cord channel within the corresponding reinforcing channel configured to allow a balance cord of a balance to extend therethrough without interfering with the movement of the first and second channel reinforcement apparatus, respectively, between the open location and the closed location.

14. A window assembly comprising:

a window frame including a first jamb and a second jamb, wherein the window frame defines a frame opening;

a first sash mounted in the frame opening between the first and second jambs;

a second sash mounted in the frame opening between the first and second jambs, wherein the second sash is configured to move along a length of the first and second jambs between an open position and a closed position;

a first jamb channel in the first jamb and a second jamb channel in the second jamb;

a first latch mechanism and a second latch mechanism attached to the second sash, wherein the first latch mechanism comprises a first latch bolt configured to move within the first jamb channel of the first jamb as the second sash is moved between the open position and the closed position, and wherein the second latch mechanism comprises a second latch bolt configured to move within the second jamb channel of the second jamb as the second sash is moved between the open position and the closed position;

a first channel reinforcement apparatus located in the first channel and a second channel reinforcement apparatus located in the second channel, wherein the first channel reinforcement apparatus is configured to move within the first channel between an open location and a closed location, wherein the first channel reinforcement apparatus is in its open location when the second sash is in the open position and the first channel reinforcement apparatus is in its closed location when the second sash is in the closed position, and wherein the second channel reinforcement apparatus is configured to move within the second channel between an open location and a closed location, wherein the second channel reinforcement apparatus is in its open location when the second sash is in the open position and the second channel reinforcement apparatus is in its closed location when the second sash is in the closed position;

a first balance located in the first jamb channel and coupled to the second sash;

a second balance located in the second jamb channel and coupled to the second sash;

wherein the first channel reinforcement apparatus is coupled to the first balance and the second channel reinforcement apparatus is coupled to the second balance, wherein each of the first channel reinforcement apparatus and the second channel reinforcement apparatus is configured to move with the first and second balance, respectively, when the second sash moves between the open position and the closed position;

and wherein the first and second channel reinforcement apparatus are configured to provide reinforcement to the first and second jamb channels, respectively, when located in their respective closed locations by distributing forces applied to the first and second channel reinforcement apparatus by the first and the second latch bolts, respectively.

15. The window assembly of claim 14, wherein the first and second channel reinforcement apparatus are configured to distribute the forces applied by the first and the second latch bolts, respectively, to the first and second jambs, respectively.

16. The window assembly of claim 14, wherein each of the first and second channel reinforcement apparatus comprises a reinforcing block extending from a first end to a second end and defining a reinforcing channel extending from the first end to the second end, wherein the reinforcing channel of the first channel reinforcement apparatus is configured to engage the first latch bolt of the first latch mechanism of the second sash when the first channel reinforcement apparatus is in its closed location, and wherein the reinforcing channel of the second channel reinforcement apparatus is configured to engage the second latch bolt of the second latch mechanism of the second sash when the second channel reinforcement apparatus is in its closed location.

17. The window assembly of claim 16, wherein the reinforcing block of the first channel reinforcement apparatus is configured to provide reinforcement to the first jamb channel when the first channel reinforcement apparatus is in its closed location by distributing forces applied to the reinforcing block of the first channel reinforcement apparatus by the first latch bolt, and wherein the reinforcing block of the second channel reinforcement apparatus is configured to provide reinforcement to the second jamb channel when the second channel reinforcement apparatus is in its closed location by distributing forces applied to the reinforcing block of the second channel reinforcement apparatus by the second latch bolt.

18. The window assembly of claim 17, wherein the reinforcing block of the first channel reinforcement apparatus is configured to distribute the forces applied by the first latch bolt to at least a portion of the first jamb, and wherein the reinforcing block of the second channel reinforcement apparatus is configured to distribute the forces applied by the second latch bolt to at least a portion of the second jamb.

* * * * *